US006875336B2

(12) United States Patent
Lewis et al.

(10) Patent No.: US 6,875,336 B2
(45) Date of Patent: Apr. 5, 2005

(54) PROCESS AND APPARATUS FOR PREVENTING OXIDATION OF METAL

(75) Inventors: Michael E. Lewis, Hartsville, OH (US); Mark Swannie, Mililani, HI (US)

(73) Assignee: Canadian Auto Preservation, Inc., Concord (CA)

( * ) Notice: Subject to any disclaimer, the term of this patent is extended or adjusted under 35 U.S.C. 154(b) by 566 days.

(21) Appl. No.: 10/010,402

(22) Filed: Dec. 7, 2001

(65) Prior Publication Data

US 2002/0088720 A1 Jul. 11, 2002

Related U.S. Application Data

(63) Continuation-in-part of application No. 09/527,552, filed on Mar. 17, 2000, now Pat. No. 6,331,243.

(60) Provisional application No. 60/044,898, filed on Apr. 25, 1997.

(51) Int. Cl.[7] ..... C23F 13/00

(52) U.S. Cl. ..... 205/724; 205/727; 205/728; 205/729; 204/196.21; 204/196.36

(58) Field of Search ..... 204/196.21, 196.36; 205/724, 727, 728, 729

(56) References Cited

U.S. PATENT DOCUMENTS 3,242,064 A * 3/1966 Byrne ..... 204/196.03
3,692,650 A * 9/1972 Kipps ..... 205/729
4,647,353 A * 3/1987 McCready ..... 205/737
4,767,512 A * 8/1988 Cowatch et al. ..... 205/729
4,828,665 A * 5/1989 McCready ..... 204/196.03
4,950,372 A * 8/1990 McCready ..... 205/729
5,102,514 A * 4/1992 McCready ..... 205/729
6,046,515 A * 4/2000 Lewis ..... 307/95
6,331,243 B1 * 12/2001 Lewis ..... 205/727

* cited by examiner

*Primary Examiner*—Bruce F. Bell

(57) ABSTRACT

An apparatus for prevention of corrosion in metal objects uses a capacitively coupled fastener or pad attached to a metal body being protected from corrosion. The metal body and the negative terminal of a source of DC voltage (battery) are grounded. The positive terminal of the source of DC voltage is connected to electronic circuitry that imparts pulses of low voltage DC through the capacitor to the fastener. These pulses of electrical current inhibit the oxidation of the metal object by providing a source of electrons to the oxidizing chemicals in contact with the metal. The electronic circuitry includes a reverse voltage protector to prevent the application of reverse source voltage. The circuitry also includes a power conditioner to supply a constant DC voltage to a microprocessor. The microprocessor generates pulses of DC signals that are amplified by a pulse amplifier and imparted to the conductive facing of the pad. For larger objects, a first and second cable are attached to a metal object. A phase compensated signal is applied to each cable to provide a phase synchronous signal at the metal object. The invention also includes a battery voltage monitor and a power indicator to indicate battery level. When the battery voltage drops below a reference level, the microprocessor senses this low voltage condition and shuts off operation of the pulse amplifier, thereby conserving battery power.

7 Claims, 6 Drawing Sheets

PROCESS AND APPARATUS FOR PREVENTING OXIDATION OF METAL

CROSS REFERENCE TO RELATED APPLICATIONS

This application claims priority from U.S. Provisional Patent Application No. 60/044,898 filed Apr. 25, 1997, which is incorporated herein by reference in its entirety and is a continuation in part of U.S. patent application Ser. No. 09/527,552 filed Mar. 17, 2000 now U.S. Pat. No. 6,331,243 entitled "Process and Apparatus for Preventing Oxidation of Metal" by Lewis.

FIELD OF THE INVENTION

The present invention relates to a process and apparatus for phase compensated prevention of oxidation of metal objects in an oxidizing environment. An oxidizing environment is characterized by the presence of at least one chemical, the atoms of which in that environment, are capable of being reduced by acquiring at least one electron from the atoms of the metal. In "donating" an electron, the metal becomes oxidized.

BACKGROUND OF THE INVENTION

In an oxidizing environment, there are substances that under suitable conditions, take up electrons and become reduced. These electrons come from the atoms of metal objects exposed to the oxidizing environment, which ends up being oxidized. As the process of oxidation continues, a metal object becomes degraded to the point that it can no longer be used for its intended purpose.

On land, oxidation is prevalent in, among other things, bridges and vehicles, when they are exposed to salt that is spread on roads to prevent the formation of ice in cold climates. The salt melts the snow and ice and, in so doing, forms an aqueous salt solution. The iron or steel in the bridges or vehicles, when exposed to the salt solution, is readily oxidized. The first visible sign of oxidation is the appearance of rust on the surface of the metal object. Continued oxidation leads to the weakening of the structural integrity of metal objects. If the oxidation is allowed to continue, the metal object rusts through and eventually disintegrates or, in the case of the metal in bridges, becomes too weak to sustain the load to which it is subjected. The situation has become worse in recent years with increased concentrations of pollutants and the demand for lighter, more fuel efficient vehicles requiring thinner sheet metal and the abandonment of mainframe construction.

The same aqueous salt solution is also the cause of corrosion in a marine environment and is responsible for the oxidation of hulls of ships, offshore pipelines, and drilling and production platforms used by the oil industry.

Early methods of corrosion prevention relied on applying a protective coating, for example of paint, to the metal object. This prevents the metal from coming in contact with the oxidizing environment and thereby prevents corrosion. Over a long time, however, the protective coating wears off and the process of oxidation of the metal could begin. The only way to prevent oxidation from starting is to reapply the coating. This can be an expensive process in the best of circumstances: it is a lot easier to thoroughly coat the parts of an automobile in a factory, before assembly, than to reapply the coating on an assembled automobile. In other circumstances, e.g., on an offshore pipeline, the process of reapplying a coating is impossible.

Other methods of prevention of oxidation include cathodic protection systems. In these, the metal object to be protected is made the cathode of an electrical circuit. The metal object to be protected and an anode is connected to a source of electrical energy, the electrical circuit being completed from the anode to the cathode through the aqueous solution. The flow of electrons provides the necessary source of electrons to the substances in the aqueous solution that normally cause oxidation, thereby reducing the "donation" of electrons coming from the atoms of the protected metal (cathode).

The invention of Byrne (U.S. Pat. No. 3,242,064) teaches a cathodic protection system in which pulses of direct current (DC) are supplied to the metal surface to be protected, such as the hull of a ship. The duty cycle of the pulses is changed in response to varying conditions of the water surrounding the hull of the ship. The invention of Kipps (U.S. Pat. No. 3,692,650) discloses a cathodic protection system applicable to well casings and pipelines buried in conductive soils, the inner surfaces of tanks that contain corrosive substances and submerged portions of structures. The system uses a short pulsed DC voltage and a continuous direct current.

The cathodic protection systems of prior art are not completely effective even for objects or structures immersed in a conductive medium such as sea water. The reason for this is that due to local variations in the shape of the structure being protected and to concentrations of the oxidizing substances in the aqueous environment, local "hot spots" of corrosion develop that are not adequately protected and, eventually, cause a breakdown of the structure. Cathodic protection systems are of little use in protecting metal objects that are not at least partially submerged in a conductive medium, such as sea water or conductive soil. As a result, metal girders of bridges and the body of automobiles are not protected by these cathodic systems.

Cowatch (U.S. Pat. No. 4,767,512) teaches a method aimed at preventing corrosion of objects that are not submerged in a conductive medium. An electric current is impressed into the metal object by treating the metal object as the negative plate of a capacitor. This is achieved by a capacitive coupling between the metal object and a means for providing pulses of direct current. The metal object to be protected and the means for providing pulses of direct current have a common ground. In a preferred embodiment of the invention, Cowatch discloses a device in which a DC voltage of 5,000 to 6,000 volts is applied to the positive plate of a capacitor separated from the metal object by a dielectric, and small, high frequency (1 kilohertz) pulses of DC voltage are superimposed on the steady DC voltage. Cowatch also refers to a puncture voltage of the dielectric material as about 10 kV.

Because of the safety hazards of having the high voltage applied at a place that exposes humans and animals to possible contact with the metal object or any other part of the capacitive coupling, Cowatch requires limitations on the maximum energy output of the invention.

The invention of Cowatch discloses a two-stage device for obtaining the pulsed DC voltage. The first stage provides outputs of a higher voltage AC and a lower voltage AC. In the second stage, the two AC voltages are rectified to give a high voltage DC with a superimposed DC pulse. The invention uses at least two transformers, one of which may be a push/pull saturated core transformer. Because of the use of transformers, the energy losses associated with the invention are high. Based on the disclosed values in the invention, the efficiency can be very low (less than 10%). The high heat dissipation may require a method of dissipating the heat. In addition, the invention provides a separate means for shutting off the device during prolonged periods of nonuse to avoid discharging the battery.

A somewhat related problem that affects submerged structures is caused by the growth of organisms. Mussels, for example, are a serious problem with municipal water supply systems and power plants. Because of their prolific growth, they clog the water intakes required for the proper operation of the water supply system or the power plant, causing a reduction in the flow of water. Expensive cleaning operations have to be carried out periodically. Barnacles and other organisms are well known for fouling the hulls of ships and other submerged parts of structures. Conventional means of dealing with this include the use of antifouling paints and thorough cleaning at regular intervals. The paints may have undesirable environmental effects while the cleaning is an expensive process, requiring that the ship be taken out of commission while the cleaning is done. Neither of these is effective in the long run.

It is a goal of the present invention to provide corrosion protection to metal objects even when the object to be protected is not immersed in an electrolyte. It is a further object of the present invention to accomplish this without exposing humans or animals to the risk of high voltages. In addition, the device should also be energy efficient, thereby reducing the drain on the power source and should not require any special means for heat dissipation. It also should, as part of the circuitry, have a battery voltage monitor that shuts off the pulse amplifier if the battery voltage drops below a predetermined threshold, thus conserving battery power. This is particularly useful because cold weather conditions under which corrosion is more likely due exposure to salt used to melt ice on roadways, also imposes greater demands on a battery for starting a vehicle. In addition to cold weather, high temperatures and humidity also lead to increased corrosion simultaneously with increased demands on battery power for starting a vehicle. It is also a goal of the present invention to inhibit the growth of organisms on submerged structures. Finally, it is also a goal of the present invention to protect the circuitry from damage if the apparatus is inadvertently connected to the battery with reversed polarity.

SUMMARY OF THE INVENTION

The present invention overcomes the problems of prior art and effectively prevents the oxidation of metal objects by capacitive coupling a fastener attached to a metal object to a source and passing pulses of direct current at a low voltage from the source through a capacitor to the fastener and thus through the metal object. The metal object is attached to the negative plate of the capacitor. The apparatus used for providing the pulses of direct current is connected to the positive plate of the capacitor on one side, and to a ground, to which the fastener and metal object is also connected, on the other side. The apparatus is directly attached to the metal object with a machine or sheet metal screw and the capacitor is contained in a separate housing.

In an alternative embodiment, a pad is used to create the positive plate of a capacitor which attaches to the metal object. The metal object acts as the negative plate. A dielectric material is interposed between the positive plate of the capacitor and the metal object. The paint on the metal object, if present, acts as an additional layer of dielectric material.

The pulses of direct current are produced by circuitry that includes a microprocessor, a reverse voltage protector, a pulse amplifier, a battery voltage monitor, a power indicator and a power conditioner to deliver pulses of direct current at a low voltage to the positive plate of the capacitor. Diodes, transistors, resistors, inductors and capacitors are used in the electronic circuit components; the circuitry does not include any transformers, thereby eliminating a major source of power loss.

In normal operation, when the exposed surface of the metal object is dry, the effective area of the capacitor is limited to the positive plate of the capacitor. When the surface of the metal is wet, or has a thin film of moisture on it, the presence of chemicals that have a sufficient reduction potential to acquire electrons from the metal increases the likelihood of oxidation and corrosion of the metal. These same chemicals that can cause corrosion also make the water or moisture film on the metal object electrically conductive; because of this, the effective area of the capacitor may increase from just the metal plate to the area covered by the electrically conductive water or film of moisture. The result of this increased capacitance is an increase in the current flowing through the circuit into the metal. Thus, the present invention is self-regulating in that the greater the possibility of corrosion, the greater the amount of protective current delivered to the metal.

The present invention is also effective, with little modification in inhibiting the growth of organisms, such as mussels and barnacles, on submerged structures.

The present invention provides two or more electrodes for attachment to large metallic structures, such as water storage tanks and metallic storage sheds or large vehicles. A first and second electrode are attached to metallic structure or vehicle being treated so that the effects of the invention are applied simultaneously at two or more points. Each of the electrodes apply a time varying electrical waveform to the object being treated. A first electrode on a short cable is applied at one point on the object and a second electrode attached to a longer cable is applied at a second point on the object being treated. A phase sensor is used to adjust the signal so that the impedance difference of the long cable and short cable does not affect the phase synchronous relationship of the two applied signals. That is, the impedance of the first and second cable is determined and the signal applied to each cable is adjusted so that the signals at the distance end of each cable are phase synchronous or are in phase. A high voltage protection circuit is provided to protect the present invention from damage from a high voltage spike or surge. A variable speed blinking led is provided to indicate battery power levels of full, marginal and low.

DETAILED DESCRIPTION OF THE INVENTION

Figure 1A:
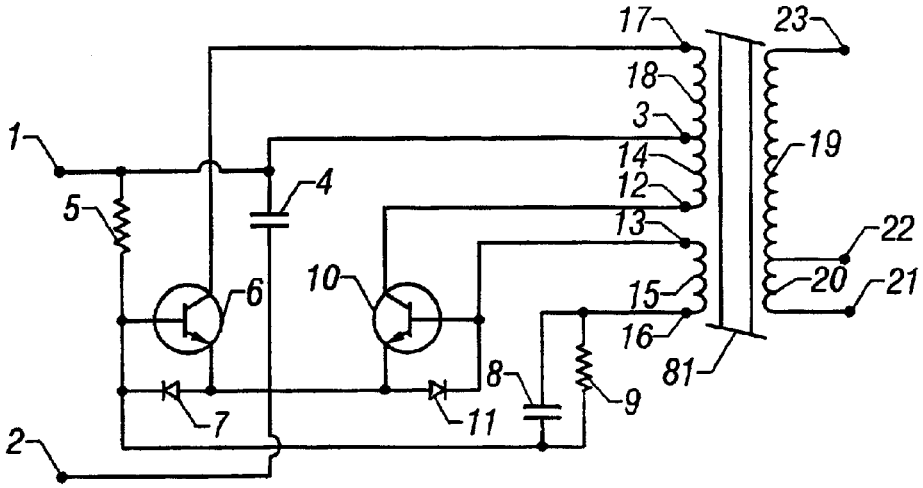
FIG. 1A (Prior Art)
FIGS. 1A–B is a circuit diagram of the prior art of Cowatch.
Figure 1B:
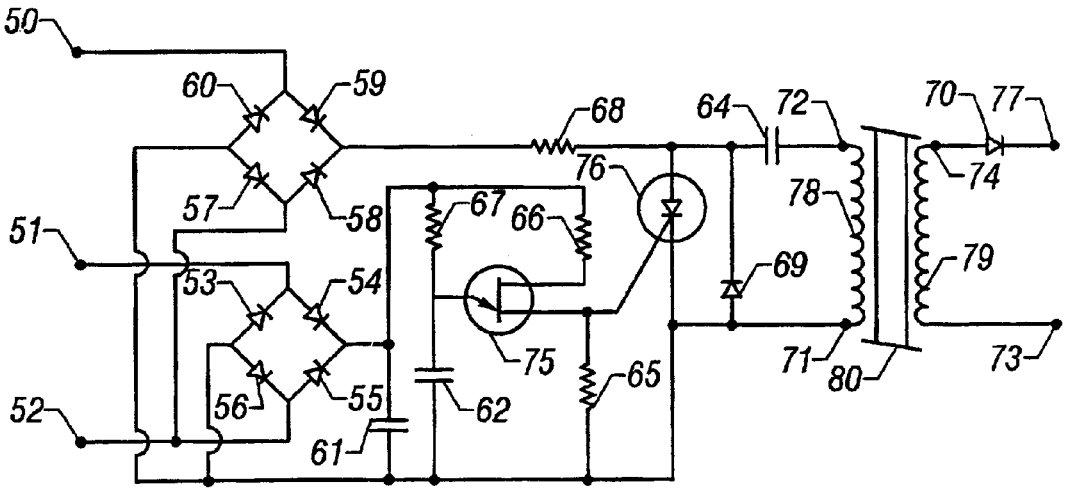
FIG. 1B (Prior Art)

The present invention is best understood by first referring to prior art methods of preventing oxidation of metal by capacitive coupling. The upper portion of FIG. 1 shows the circuit diagram of a push/pull saturated core transformer used in the invention of Cowatch. Terminal 1 is connected to the positive side of the electrical system of a vehicle and terminal 2 is connected to the negative side of the electrical system of the vehicle. The output of the transformer 81 has three taps, 21, 22 and 23. The tap 21 provides the system ground, 22 provides 12 volts AC and 23 provides 400 volts AC. The output from the first stage is fed to the second stage, a rectifier pulsator, the circuit diagram of which is shown in the bottom portion of FIG. 1. The 400 volt AC from 23 is fed to 50, the 12 volt AC from 22 is connected to 51 while the ground 21 is connected to 52. The output of the rectifier pulsator, between 77 and 73, is a 400 volts DC with 12 volts pulses superimposed on the 400 volts DC.

The prior art invention delivers a high voltage DC with low voltage pulses superimposed on the high voltage DC to a positive plate of a capacitor connected between 73 and 77. The positive plate of the capacitor is separated from and coupled to the grounded metal object by means of a capacitive pad.

Figure 2:
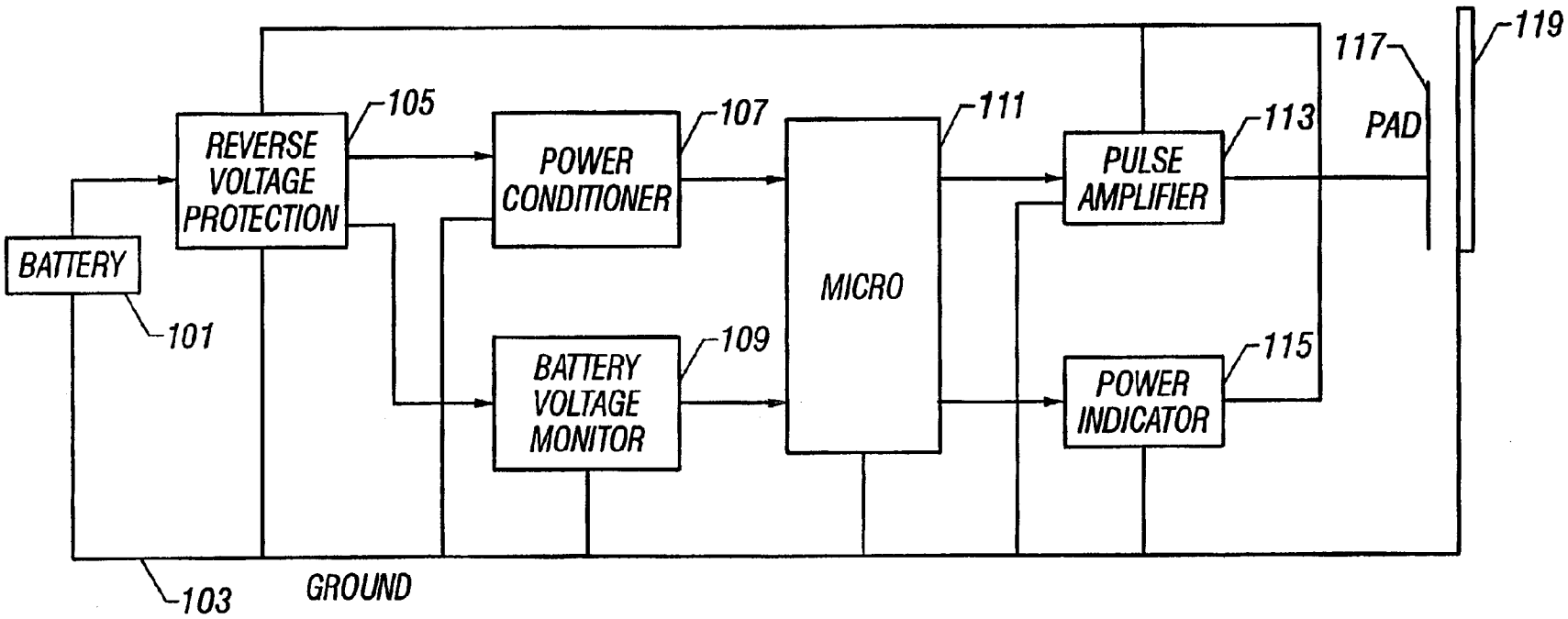
FIG. 2 is a schematic diagram of the apparatus of the present invention.

FIG. 2 is a functional block diagram illustrating the operation of the apparatus of the present invention. The battery 101 is the source of DC power for the invention. One terminal of the battery is connected to the ground, 103. The positive terminal of the battery is connected to the Reverse Voltage Protector, 105. The reverse voltage protector prevents application of reverse battery voltage from being inadvertently applied to the other circuitry and damaging the components.

The Power Conditioner, 107, converts the battery voltage to the proper voltage needed by the microprocessor, 111. In the preferred embodiment, the voltage needed by the microprocessor is 5.1 volts DC. The battery voltage monitor, 109, compares the battery voltage with a reference voltage (12 volts DC in the preferred embodiment). If the battery voltage is above the reference voltage, then the microprocessor 111, activates the pulse amplifier, 113, and the power indicator, 115. When the pulse amplifier is activated by a pulse signal having a positive output of the microprocessor, an amplified pulse signal having a positive output is generated by the pulse amplifier and conveyed to the pad, 117. The pad, 117, is capacitive coupled to the metal object being protected, 119. When the power indicator 113 is activated, a power LED in the power indicator is turned on, serving as an indicator that the pulse amplifier has been activated. The use of the battery voltage monitor 109 prevents drain on the battery if the battery voltage is too low.

When the present invention is used to protect a metal object, such as the body of an automobile, the pad 117 has a substrate material similar to thin fiber glass and is attached to the object 119 by means of a high dielectric strength silicone adhesive. In the preferred embodiment, the substrate-adhesive combination has a breakdown potential of at least 10 kilovolts. The adhesive is preferably a fast curing one, which will cure sufficiently in 15 minutes to secure the dielectric material to the metal object.

Figure 3A:
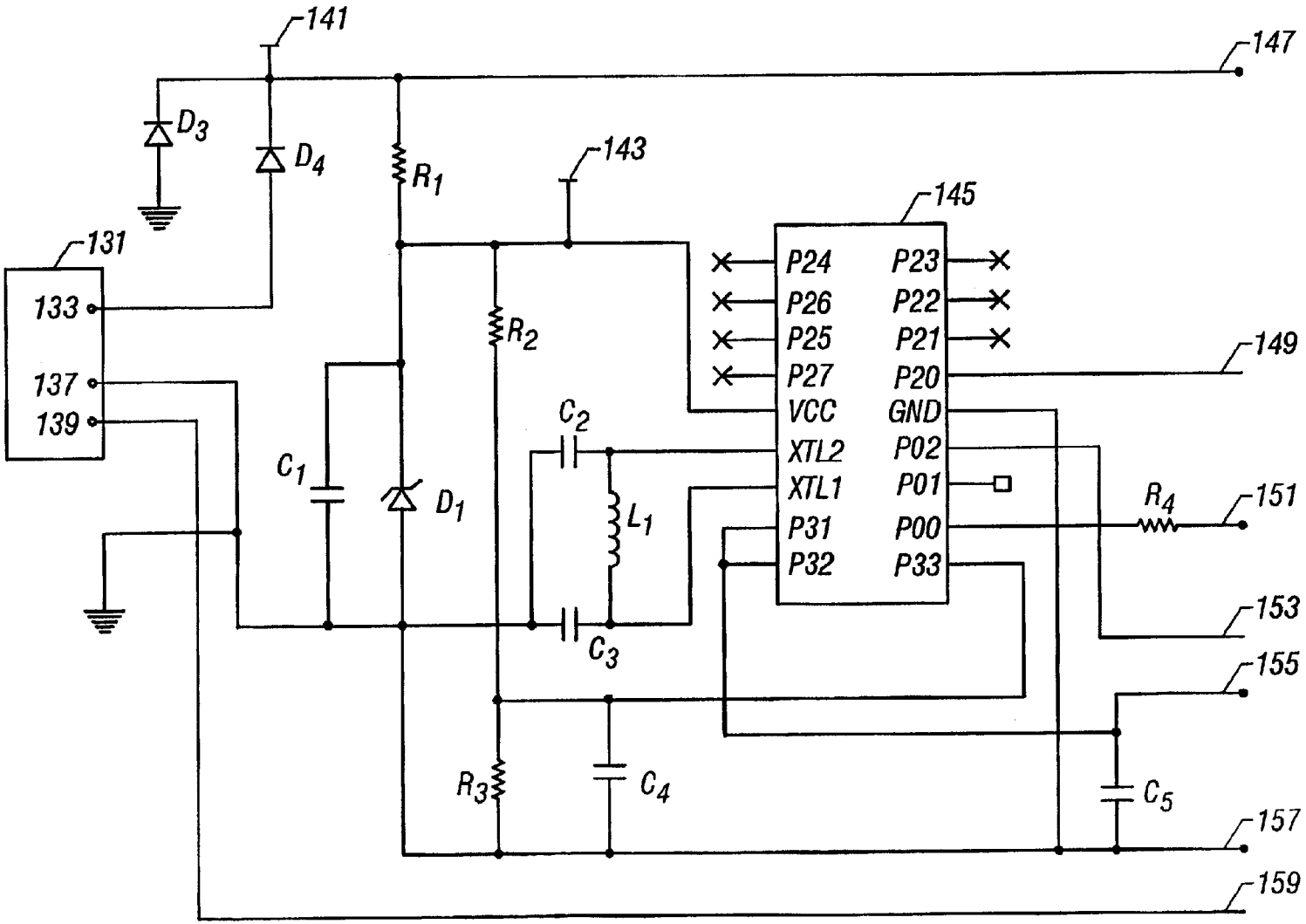
FIGS. 3A–C is a circuit diagram of the preferred embodiment of the present invention.
Figure 3B:
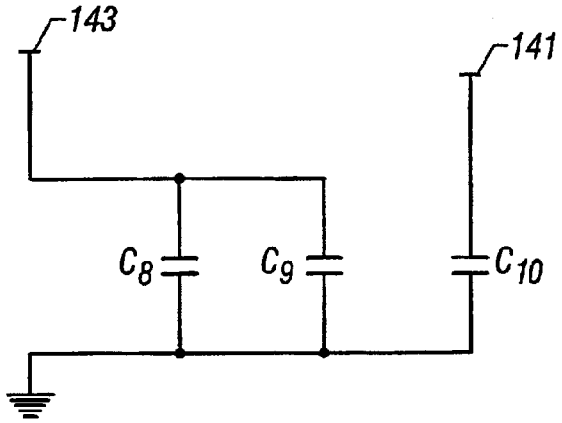
Figure 3C:
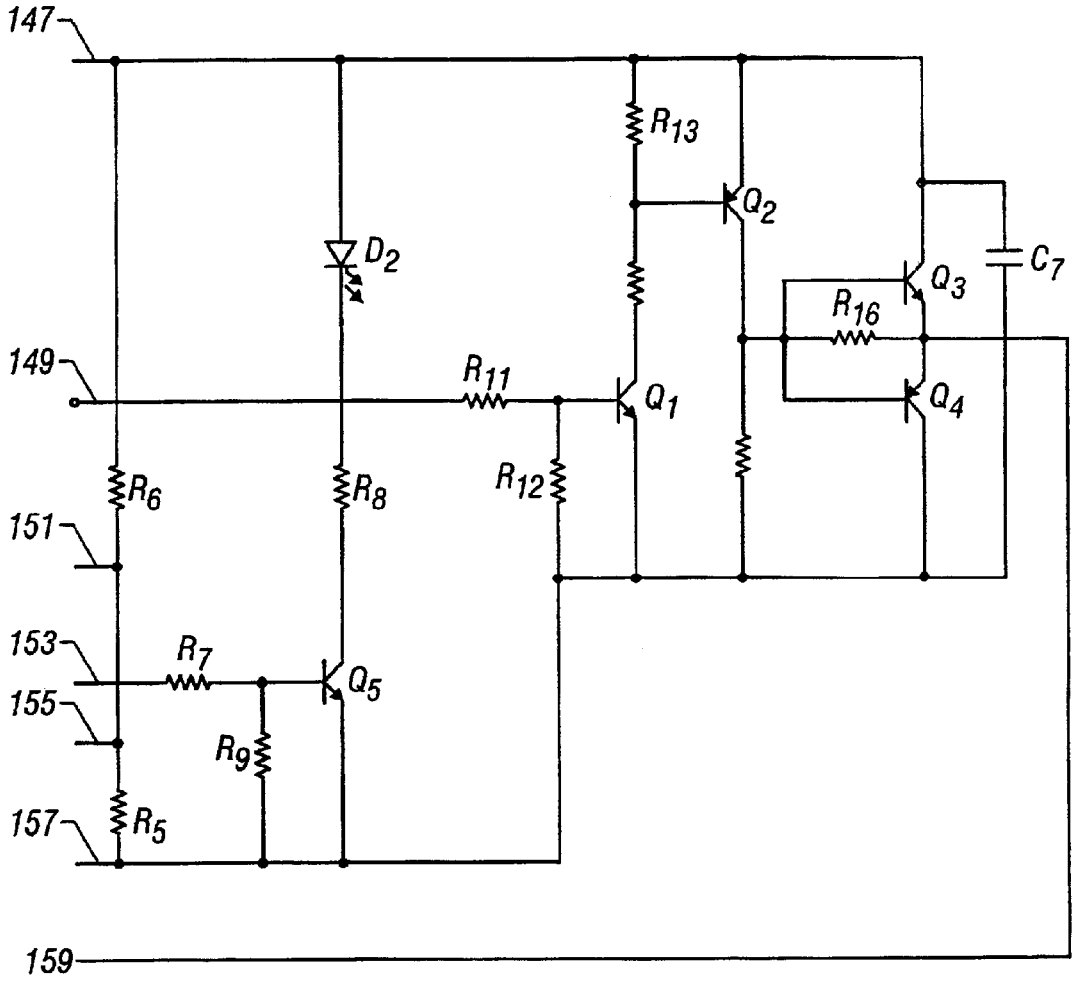

With the broad overview of the invention in FIG. 2, the details of the device, shown in FIGS. 3A–3C are easier to understand. The unit is powered from a typical car battery in which the positive terminal of the battery is connected to 133 on a connector panel 131. The negative terminal of the battery is connected to the body of the car (the "ground") and to 137 on the connector panel 131. The pad 117 from FIG. 2 is connected to 139 on the connector panel 131 while the metal object being protected, 119 in FIG. 2, is connected to the ground. The car battery, the pad 117 and the metal object being protected, 119, and their connections are not shown in FIG. 3A.

The reverse voltage protection circuit 105 of FIG. 2 comprises of the diodes D3 and D4 in FIG. 3A. In the preferred embodiment of the invention, D3 and D4 are IN4004 diodes. Those who are familiar with the art would recognize that with the configuration of the diodes as shown, the voltage at the point 141 will not be at a negative voltage with respect to the ground even if the battery is connected to the connector board 131 with reversed polarity. This protects the electronic components from damage and is an improvement over prior art.

The power conditioner circuit, 107 in FIG. 2, is made of resistor R1, Zener diode D1 and capacitor C1. These convert the nominal battery voltage of 13.5 volts to the 5.1 volts needed by the microprocessor. In the preferred embodiment, R1 has a resistance of 330 Ω, C1 has a capacitance of 0.1 μF and D1 is an IN751 diode. As would be known to those familiar with the art, a Zener diode has a highly stable reference voltage across the diode for a wide range of current through the diode.

Capacitors C8, C9 and C10 serve the function of filtering the battery voltage and the reference voltage. In the preferred embodiment, they each have a value of 0.2 μF. C8 and C9 could be replaced by a single capacitor with a value of 0.2 μF.

The battery voltage monitor comprises of resistors R2, R3, R4, R5 and R6 and capacitors C4 and C5. The voltage is monitored by a comparator in the microprocessor 145. The voltage divider, comprising of resistors R2 and R3, provides a stable reference to the pin P33 of the microprocessor 145. In the preferred embodiment, R2 and R3 each have a resistance of 100 KΩ. Accordingly, with the reference voltage of the Zener diode D1 of 5.1 volts, the voltage at pin P33 of the microprocessor would be 2.55 volts. In the preferred embodiment, the microprocessor 145 is a Z86ED4M manufactured by Zilog.

The battery voltage is divided by the resistors R5 and R6 and applied to the comparator input pins P31 and P32. In the preferred embodiment, R5 has a resistance of 180K and R6 has a resistance of 100 KU. The comparator in the microprocessor 145 compares the battery voltage divided by R5 and R6, at pins P31 and P32, with the divided reference of 2.55 volts at pin P33. Whenever the voltage at pins P31 and P32 drops below the reference voltage at pin P33, microprocessor senses a low battery voltage and stops sending signals to the pulse amplifier (discussed below). The necessity for connecting pin P00 to the junction of resistors R5 and R6 through resistor R4 arises because the comparator is responsive only to transitions wherein the voltage at pins P31 and P32 drops below the reference voltage at pin P33. The pin P00 is pulsed approximately every one second or so between 0 volts and 5 volts by the microprocessor. When the pin P00 is at zero volts, then with a resistance of 100 KU for resistor R4 in the preferred embodiment, the voltage at pins P31 and P32 is below the 2.55 volts reference voltage at pin P33 when the battery voltage is below 11.96 volts. When the pin P00 is at 5 volts, the voltage at P31 and P32 is above 2.55 volts. By this means, the microprocessor is able to sense a low battery voltage in continuous operation. Capacitors C4 and C5 provide AC filtering for these voltages.

Those familiar with the art would recognize that the requirement for cycling pin P00 between two voltage levels, and the requirement for resistor R4, would not be necessary in other microprocessors in which the comparator may be responsive to actual differences between a reference voltage and a battery voltage, rather than to a transition of the battery voltage below the reference voltage.

The use of a microprocessor to generate pulses of DC voltage and the use of a battery voltage monitor to shut down the apparatus when the battery voltage drops below a reference level are improvements over prior art methods. The Power Indicator comprises an LED D2, transistor Q5 and resistors R7, R8 and R9. The transistor Q5 is driven on by a positive output of the microprocessor at pin P02. When the transistor Q5 is on, the LED D2 is lit. If the battery voltage is reduced to a nominal 12 V, the microprocessor does not have a positive output at pin P02 and the LED D2 is turned off. When the battery voltage rises above a nominal 12 volts, the microprocessor has a positive output on pin P02 and the LED D2 is turned on.

In the preferred embodiment, Q5 is a 2N3904 transistor, R7 has a resistance of 3.9 KΩ, R8 has a resistance of 1 KΩ and R9 has a resistance of 10 KΩ.

When the battery voltage is above the nominal 12 V, the microprocessor also produces an output pulse on pin P20. This is sent to the Pulse Amplifier, comprising of resistors R11–R16 and transistors Q1–Q4. In the preferred embodiment, Q1, Q3 and Q5 are 2N3904 transistors, Q2 and Q4 are 2N2907 transistors; R11 has a resistance of 2.7 KΩ, R12 and R13 each have a resistance of 1 KΩ, R14 and R15 have resistances of 390 Ω, and R16 has a resistance of 1 KΩ. The capacitor C7 provides AC filtering for the pulse amplifier circuit and, in the preferred embodiment, has a capacitance of 20 $\mu$F. The output of the pulse amplifier is applied, through 139 in the connector panel 131, to the coupling pad 117 that is attached to the car body. The output has a nominal amplitude of 12 volts.

With the complete absence of any transformers in the invention, high efficiency can be readily achieved. This reduces the drain on the battery and is an improvement over prior art. In the preferred embodiment, the signal from pin P20 of the microprocessor comprises of a 5 V, 3.5 is wide pulse that occurs at a nominal 11 kHz repetition rate. A range of pulse durations between 1 is and 10.0 is has been found to be satisfactory. A repetition rate of between 5 kHz and 50 kHz has been found to be acceptable. A pair of important parameters is the rise and fall times of the amplified pulse signal that is applied to the pad 117. In the preferred embodiment, the rise time and the fall time of each pulse that forms the amplified pulse signal are both less than 200 nanoseconds.

The clock for the microprocessor in the preferred embodiment is the resonant circuit comprising of capacitors C2 and C3 and the inductor L1. Use of this circuit is more cost effective than a quartz crystal for controlling the microprocessor clock. This is an improvement over prior art. In the preferred embodiment, C2 and C3 have a capacitance of 100 pF while the inductor L1 has an inductance of 8.2 $\mu$H. Those familiar with the art would recognize that other devices or circuits could be used to provide the timing mechanism for the microprocessor.

Figure 4:
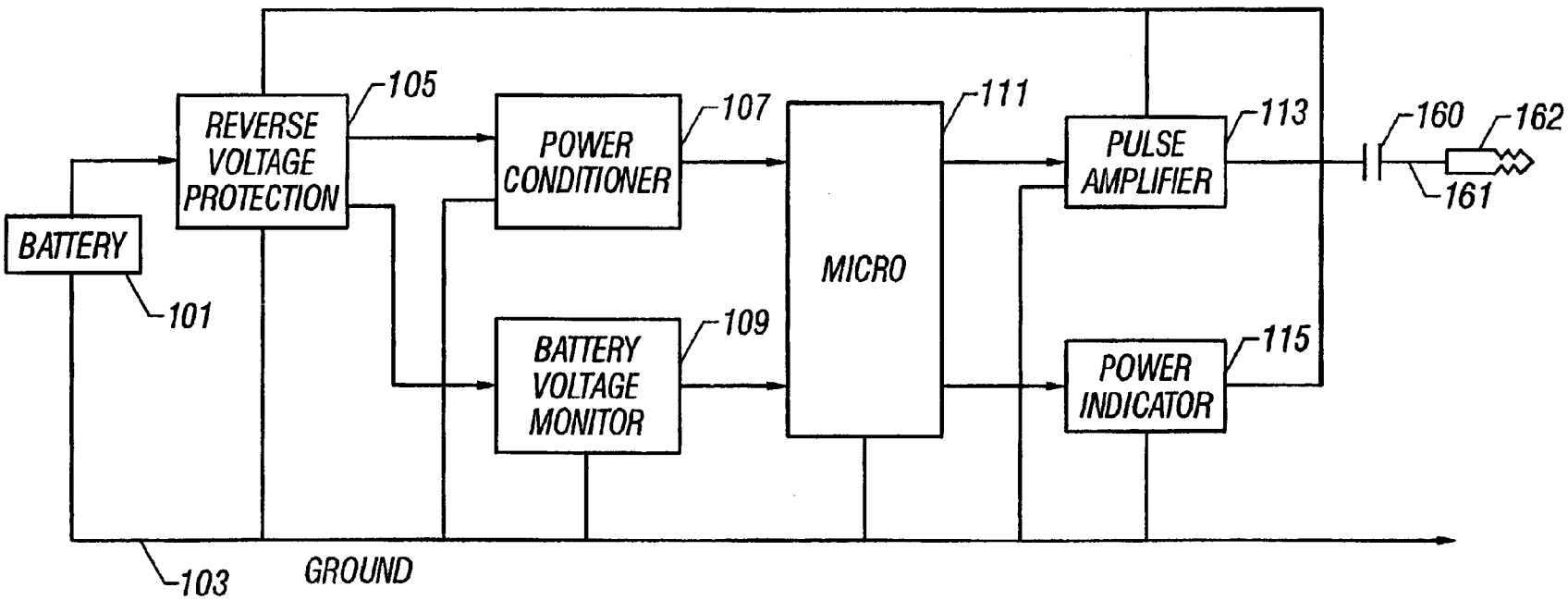
FIG. 4 is an alternative embodiment of the present invention.

Turning now to FIG. 4, an alternative embodiment of the present invention is illustrated which utilizes an internal capacitor 160, lead 161 and fastener 162 to deliver pulses to the metal object 119, instead of capacitive pad 117. In FIG. 4, the output of pulse amplifier 113 is attached to the positive side of capacitor 160. The negative side of capacitor 113 is attached to lead 161 which is attached to fastener 162. The output pulses from pulse amplifier 113 are thus transmitted to metal object 119 via the path formed by capacitor 160, lead 161 and fastener 162 which is attached to metal object 119.

Figure 5:
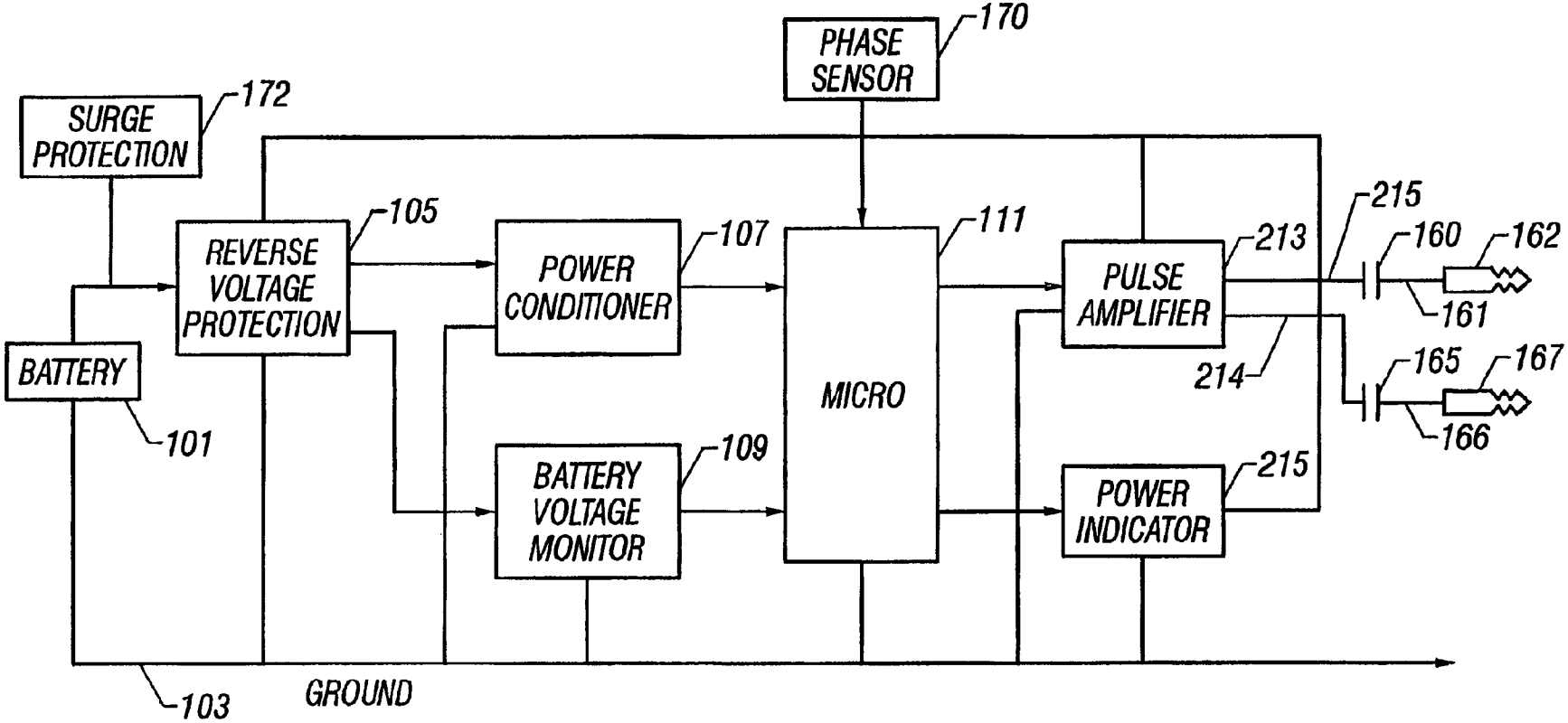
FIG. 5 is a preferred embodiment of the preferred phase compensation present invention.

Turning now to FIG. 5 a preferred embodiment of the present invention is shown illustrating the phase sensor and adjustment circuitry for system provided two or more electrodes. The present invention provides two or more electrodes for attachment to large metallic structures, such as water storage tanks and metallic storage sheds or large vehicles. A first and second electrode are attached to metallic structure or vehicle being treated so that the effects of the invention are applied simultaneously at two or more points. Each of the electrodes apply a time varying electrical waveform to the object being treated. A first electrode on a short cable is applied at one point on the metal object and a second electrode attached to a longer cable is applied at a second point on the metal object being treated. A phase sensor is used to adjust the signal so that the impedance difference of the long cable and short cable does not affect the phase synchronous relationship of the two applied signals. That is, the phase relationship of the signals applied to the metal object and complex impedance of the first and second cable is determined and the signal applied to each cable is phase compensated and adjusted so that the signals at the distant end of each cable are phase synchronous or are in phase when applied to the metal object. A high voltage protection circuit is provided to protect the present invention from damage from a high voltage spike or surge. A variable speed blinking led is provided to indicate battery power levels of full, marginal and low.

As shown in FIG. 5, a first lead 161 and a second lead 166 are driven by pulse amplifier 213. Pulse amplifier 213 contains phase delay circuitry to adjust for any phase delay due to impedance differences between cable 161 and cable 166 which may be of different lengths and thus exhibit different impedances and phase delays. Different impedance in each cable tends to independently shift the phase of each output signal at the distant end of the cable as applied to the object via fastener 162 or 167. Thus, the present invention provides phase compensation, that is, phase sensing of each out put signal at the fastener or application point to an object and appropriate phase compensation or delay to bring each output signal into phase synchronization. Thus, the present invention monitors and adjusts the phase of the output signal at each fastener 162 and 167. Otherwise, the applied signals can be out of phase synchronization and cause the application of the output signals to be less effective. It is more electrically efficient to adjust the phase of each fastener applied signal so that the peak of each fastener signal is coincident with the peak of other fastener signals applied to a metal object. Thus, the present invention insures that each signal at each fastener applied to a metal object is phase synchronous.

The phase of each signal at each fastener can be determined by attaching each fastener 162 and 167 to a phase sensor 170 to determine the phase relationship of each signal at each fastener 162 and 167, after the signal has passed through the delivery cables 161 and 166 and capacitors 160 and 165. The microprocessor 111 determines a phase difference and sends a phase delay signal to pulse amplifier 213, which applies a phase delay signal to pulses sent to each cable so that the signals are in phase synchronization when applied to an object through the fasteners. The phase sensor and pulse amplifier can also sense and adjust for differences in the complex impedance between two applied signals. A similar circuit is used to adjust the phase of applied signals in the embodiment where capacitive coupling is used to apply the signals to an object.

Power indicator 215 comprises a voltage sensing circuit, a flasher and a voltage indication and LED. (I think this is correct?) The power indicator circuit causes the LED to flash at ⅛ second frequency when the supply voltage is twelve volts, at ¼ second frequency when the supply voltage is less than twelve volts and greater than 11.7 volts, and at ¼ second frequency when the supply voltage is less than 11.7 volts. A surge protection circuit 172 is provided to protect the present invention from high voltages due to regulator failure or other sources of high voltage.

The foregoing is intended to be a description of the preferred embodiment of the invention. Variations of the disclosed embodiment may be easily made and are intended to be within the scope of the invention.

What we claim is:

1. An apparatus for prevention of oxidation of a metal object connected to an electrical ground, said metal object being in an oxidizing environment, comprising:

(a) a source of DC voltage connected to the ground, said source having a first voltage;

(b) a first fastener attached to the metal object;

(c) a second fastener attached to the metal object (d) a first and second capacitor each having a negative side and a positive side, each negative side coupled to a fastener;

(e) a pulse amplifier having phase compensation circuitry coupled to a positive side of each capacitor, said pulse amplifier adapted to provide an phase compensated amplified pulsed signal to each capacitor thereto upon provision of a pulsed signal; and (f) a phase sensor for determining the phase of each signal at each fastener; and (e) a microprocessor operatively coupled to the source of DC voltage and to the pulse amplifier, the microprocessor providing a phase compensation signal for each pulsed signal to the pulse amplifier so that each signal applied to the metal object is in phase.

2. The apparatus of claim 1 further comprising a voltage monitor coupled to the source of DC voltage wherein the voltage monitor provides a difference signal to the microprocessor indicative of the difference between the first voltage and a reference voltage wherein an LED flashes at ⅛ second when the source voltage is 12 volts, flashes at ¼ second when the source voltage is between 11.7 volt and 11.9 volts and flashes at ½ second when the source voltage is less than 11.7 volts.

3. The apparatus of claim 1 further comprising a high voltage protection circuit.

4. A method for alleviation of oxidation of a metal object in an oxidizing environment comprising:

(a) connecting the metal object to an electrical ground;

(b) connecting a source of DC voltage having a first voltage to the ground;

(b) attaching a first fastener to the metal object;

(c) attaching a second fastener to the metal object;

(c) connecting a capacitor to each fastener;

(d) operatively coupling a microprocessor to the source of DC voltage and to a pulse amplifier, (d) using the microprocessor to provide a pulsed signal to the pulse amplifier;

(e) determining a phase relationship between a signal applied to the metal object at the first fastener and a signal applied to the metal object at the second fastener;

(f) adjusting the phase relationship of the signal applied to generated the first and second signals applied to the metal object so that the first and second applied signals are in phase when applied to the metal object; and (g) providing the amplified pulses to the fastener via the capacitor.

5. The method of claim 4 further comprising:

monitoring a source of DC voltage;

flashing a LED at ⅛ second frequency when the source voltage is 12 volts;

flashing the LED at ¼ second frequency when the source voltage is between 11.7 volt and 11.9 volts;

and flashing the LED at ½ second frequency when the source voltage is less than 11.7 volts.

6. The method of claim 4 further comprising:

providing a high voltage protection circuit.

7. An apparatus for prevention of oxidation of a metal object connected to an electrical ground, said metal object being in an oxidizing environment, comprising:

(a) a source of DC voltage connected to the ground, said source having a first voltage;

(b) a first fastener attached to the metal object;

(c) a second fastener attached to the metal object;

(c) a capacitor having a positive side and a negative side, the fastener coupled to the negative side of the capacitor;

(d) a pulse amplifier coupled to the positive side of the capacitor, said pulse amplifier adapted to provide a separate phase compensated amplified pulsed signal thereto upon provision of a pulsed signal to each fastener; and (e) a microprocessor operatively coupled to the source of DC voltage and to the pulse amplifier, the microprocessor providing the pulsed signal to the pulse amplifier wherein each pulsed signal applied to the metal object is phase compensated so that the first and second applied signals are in phase.

* * * * *